US007425797B2

(12) United States Patent
Woo et al.

(10) Patent No.: US 7,425,797 B2
(45) Date of Patent: Sep. 16, 2008

(54) PLASMA DISPLAY PANEL HAVING PROTRUSION ELECTRODE WITH INDENTATION AND APERTURE

(75) Inventors: Seok-Gyun Woo, Asan-si (KR); Tae-Kyoung Kang, Asan-si (KR); Woo-Tae Kim, Yongin-si (KR); Kyoung-Doo Kang, Seoul (KR); Hun-Suk Yoo, Cheonan-si (KR); Jae-Ik Kwon, Asan-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 0 days.

(21) Appl. No.: 10/885,296

(22) Filed: Jul. 2, 2004

(65) Prior Publication Data

US 2005/0029939 A1 Feb. 10, 2005

(30) Foreign Application Priority Data

Jul. 4, 2003 (KR) ..... 10-2003-0045199
Jul. 22, 2003 (KR) ..... 10-2003-0050278
Jul. 30, 2003 (KR) ..... 10-2003-0052598
Aug. 1, 2003 (KR) ..... 10-2003-0053461

(51) Int. Cl.
*H01J 17/49* (2006.01)

(52) U.S. Cl. ..... 313/584; 313/582

(58) Field of Classification Search ..... 313/582–587; 345/37, 41, 60, 71; 315/169.4
See application file for complete search history.

(56) References Cited

U.S. PATENT DOCUMENTS 5,640,068 A 6/1997 Amemiya
5,661,500 A 8/1997 Shinoda et al.

(Continued)

FOREIGN PATENT DOCUMENTS

CN 1264914 8/2000

(Continued)

OTHER PUBLICATIONS

Patent Abstracts of Japan, Publication No. 2001-160361, Publication Date Jun. 12, 2001, in the name of Yura, et al.

(Continued)

*Primary Examiner*—Joseph Williams
*Assistant Examiner*—Bumsuk Won
(74) *Attorney, Agent, or Firm*—Christie, Parker & Hale, LLP

(57) ABSTRACT

A plasma display panel. A first substrate and a second substrate are provided opposing one another with a predetermined gap therebetween. Address electrodes are formed on the second substrate. Barrier ribs are mounted between the first substrate and the second substrate defining a plurality of discharge cells. Phosphor layers are formed within the discharge cells. Discharge sustain electrodes are formed on the first substrate. The discharge sustain electrodes include bus electrodes that extend such that a pair of the bus electrodes is provided for each of the discharge cells, and protrusion electrodes extending from each of the bus electrodes such that a pair of opposing protrusion electrodes is formed within an area corresponding to each discharge cell. A distal end of each protrusion electrode includes an indentation such that a gap is formed between the pair of opposing protrusion electrodes, and an aperture is formed in each protrusion electrode.

25 Claims, 10 Drawing Sheets

U.S. PATENT DOCUMENTS

| | | | | |
|---|---|---|---|---|
| 5,952,782 | A | 9/1999 | Nanto et al. | |
| 6,200,182 | B1 | 3/2001 | Nanto et al. | |
| 6,249,264 | B1 | 6/2001 | Sano et al. | |
| 6,288,488 | B1 | 9/2001 | Amemiya | |
| 6,373,195 | B1 | 4/2002 | Whang et al. | |
| 6,376,986 | B1 | 4/2002 | Takagi et al. | |
| 6,424,095 | B1 | 7/2002 | Hirao et al. | |
| 6,479,932 | B1 | 11/2002 | Nunomura | |
| 6,495,957 | B2 | 12/2002 | Kurogi et al. | |
| 6,522,072 | B1 | 2/2003 | Yura et al. | |
| 6,534,914 | B2 | 3/2003 | Amemiya et al. | |
| 6,608,441 | B2 | 8/2003 | Kunii et al. | |
| 6,639,363 | B2 * | 10/2003 | Amatsuchi et al. | 313/582 |
| 6,657,386 | B2 | 12/2003 | Koshio et al. | |
| 6,670,754 | B1 * | 12/2003 | Murai et al. | 313/582 |
| 6,703,772 | B2 * | 3/2004 | Hasegawa et al. | 313/384 |
| 6,707,259 | B2 | 3/2004 | Nagao et al. | |
| 6,838,828 | B2 | 1/2005 | Joo et al. | |
| 6,853,136 | B2 * | 2/2005 | Kim et al. | 313/582 |
| 6,870,314 | B2 | 3/2005 | Kifune et al. | |
| 6,946,785 | B2 | 9/2005 | Ito et al. | |
| 2002/0021090 | A1 | 2/2002 | Sano et al. | |
| 2002/0063510 | A1 | 5/2002 | Yura et al. | |
| 2003/0193487 | A1 * | 10/2003 | Yatsuda et al. | 345/204 |
| 2004/0051457 | A1 * | 3/2004 | Kimura et al. | 313/586 |
| 2004/0085264 | A1 * | 5/2004 | Takada et al. | 345/60 |
| 2004/0113555 | A1 * | 6/2004 | Han et al. | 313/586 |
| 2004/0256989 | A1 | 12/2004 | Kim et al. | |
| 2004/0263078 | A1 | 12/2004 | Seok et al. | |
| 2005/0001551 | A1 | 1/2005 | Kim et al. | |
| 2005/0017637 | A1 | 1/2005 | Kyoung et al. | |
| 2005/0088094 | A1 | 4/2005 | Kim et al. | |
| 2005/0212430 | A1 | 9/2005 | Ahn et al. | |

FOREIGN PATENT DOCUMENTS

| | | | |
|---|---|---|---|
| CN | 1267877 | | 9/2000 |
| CN | 1327253 | | 12/2001 |
| CN | 1337665 | | 2/2002 |
| CN | 1344005 | | 4/2002 |
| CN | 1397976 | | 2/2003 |
| EP | 0 920 048 | A2 | 6/1999 |
| EP | 1 263 014 | A1 | 12/2002 |
| JP | 4-298936 | | 10/1992 |
| JP | 5-94772 | | 4/1993 |
| JP | 6-44907 | | 2/1994 |
| JP | 6-342631 | | 12/1994 |
| JP | 7-65728 | | 3/1995 |
| JP | 10-149771 | | 6/1998 |
| JP | 10-269951 | | 10/1998 |
| JP | 10-283934 | | 10/1998 |
| JP | 10-308179 | | 11/1998 |
| JP | 10-334811 | | 12/1998 |
| JP | 11-31460 | | 2/1999 |
| JP | 11-96921 | | 4/1999 |
| JP | 11-213893 | | 8/1999 |
| JP | 11-317170 | | 11/1999 |
| JP | 11-345570 | | 12/1999 |
| JP | 2000-11899 | | 1/2000 |
| JP | 2000-21313 | | 1/2000 |
| JP | 2000-42661 | | 2/2000 |
| JP | 2000-82407 | | 3/2000 |
| JP | 2000-113828 | | 4/2000 |
| JP | 2000-187200 | | 7/2000 |
| JP | 2000-195431 | | 7/2000 |
| JP | 2000-323045 | | 11/2000 |
| JP | 2000-357459 | | 12/2000 |
| JP | 2001-160361 | | 6/2001 |
| JP | 2001-210241 | | 8/2001 |
| JP | 2001-283734 | | 10/2001 |
| JP | 2001-345054 | | 12/2001 |
| JP | 2002-25451 | | 1/2002 |
| JP | 2002-83545 | | 3/2002 |
| JP | 2002-93327 | | 3/2002 |
| JP | 2002-190256 | | 7/2002 |
| JP | 2002-197981 | | 7/2002 |
| JP | 2002-203487 | | 7/2002 |
| JP | 2002-231146 | | 8/2002 |
| JP | 2002-245943 | | 8/2002 |
| JP | 2002-260537 | | 9/2002 |
| JP | 2002-324488 | | 11/2002 |
| JP | 2002-373593 | | 12/2002 |
| JP | 2003-16944 | | 1/2003 |
| JP | 2003-31130 | | 1/2003 |
| JP | 2003-68212 | | 3/2003 |
| JP | 2003-68215 | | 3/2003 |
| JP | 2003-132805 | | 5/2003 |
| JP | 2003-157773 | | 5/2003 |
| JP | 2003-303550 | | 10/2003 |
| JP | 2003-303551 | | 10/2003 |
| JP | 2004-164885 | | 6/2004 |
| KR | 1998-030878 | | 8/1998 |
| KR | 1999-0062632 | | 7/1999 |
| KR | 1999-0065408 | | 8/1999 |
| KR | 2001-0016651 | | 3/2001 |
| KR | 2001-0062222 | | 7/2001 |
| KR | 2001-0093724 | | 10/2001 |
| KR | 2002-0036012 | | 5/2002 |
| KR | 2002-0055807 | | 7/2002 |
| KR | 2002-0069025 | | 8/2002 |
| KR | 2003-0033658 | | 5/2003 |
| KR | 2003-0044667 | | 6/2003 |
| KR | 2003-0061079 | | 7/2003 |
| KR | 10-2004-0032508 | | 4/2004 |
| WO | WO99/50877 | | 10/1999 |
| WO | WO 00/46832 | | 8/2000 |

OTHER PUBLICATIONS

Patent Abstracts of Japan, Publication No. 2002-245943, Publication Date Aug. 30, 2002, in the name of Morikawa, et al.

Patent Abstracts of Japan, Publication No. 2002-324488, Publication Date Nov. 8, 2002, in the name of Hirano, et al.

Patent Abstracts of Japan, Publication No. 2003-303550, Publication Date Oct. 24, 2003, in the name of Kan.

Patent Abstracts of Japan, Publication No. 2003-303551, Publication Date Oct. 24, 2003, in the name of Kan.

Korean Patent Abstracts, Publication No. 1020040032508 A, Publication Date Apr. 17, 2004, in the name of Lee.

U.S. Appl. No. 10/746,540, filed Dec. 23, 2003, Kwon et al.

U.S. Appl. No. 10/746,541, filed Dec. 23, 2003, Kwon et al.

U.S. Appl. No. 10/751,341, filed Jan. 2, 2004, Kwon et al.

Patent Abstracts of Japan for Publication No. 10-149771, Date of publication of application Jun. 2, 1998, in the name of N. Yatsuda et al.

Patent Abstracts of Japan for Publication No. 2001-345054, Date of publication of application Dec. 14, 2001, in the name of K. Sano et al.

Patent Abstracts of Japan for Publication No. 2002-231146, Date of publication of application Aug. 16, 2002, in the name of S. Yura et al.

Korean Patent Abstracts for Publication No. 1020030061079, Date of publication of application Jul. 18, 2003, in the name of Y. Ahn et al.

Korean Patent Abstracts for Publication No. 1020010093724; Date of publication of application Oct. 29, 2001, in the name of K. Morikawa.

Patent Abstracts of Japan for Publication No. 2001-210241; Date of publication of application Aug. 3, 2001, in the name of T. Kosaka.

Patent Abstracts of Japan for Publication No. 2002-083545, Date of publication of application Mar. 22, 2002, in the name of Y. Kunii et al.

Patent Abstracts of Japan for Publication No. 2000-195431; Date of publication of application Jul. 14, 2000, in the name of T. Komaki.

European Search Report, for Application No. 04090020.1, dated Feb. 3, 2005, in the name of Samsung SDI Co., Ltd.

Patent Abstracts of Japan for Publication No. 2002-190256, Date of publication of application Jul. 5, 2002, in the name of Y. Takada.

Korean Patent Abstracts for Publication No. 1020010062222, Date of publication of application Jul. 7, 2001, in the name of K. Amemiya et al.
Korean Patent Abstracts for Publication No. 1019990065408A; Date of publication of application Aug. 5, 1999, in the name of S. Lee.
Patent Abstracts of Japan for Publication No. 10-308179; Date of publication of application Nov. 17, 1998, in the name of K. Aoto.
Korean Patent Abstracts for Publication No. 1020020036012; Date of publication of application May 16, 2002, in the name of U. Kim.
Patent Abstracts of Japan for Publication No. 04-298936; Date of publication of application Oct. 22, 1992, in the name of T. Okajima.
Korean Utility Model Abstracts for Publication No. 2019980030878A; Date of Publication of Application Aug. 17, 1998, in the name of B. Choi.
Patent Abstracts of Japan, Publication No. 06-342631, Published Dec. 13, 1994 in the name of Noborio.
Patent Abstracts of Japan, Publication No. 10-269951, Published Oct. 9, 1998 in the name of Fumihiro.
Patent Abstracts of Japan, Publication No. 11-213893, Published Aug. 6, 1999 in the name of Toshie et al.
Patent Abstracts of Japan, Publication No. 2000-187200, Published Jul. 4, 2000 in the name of Pascale et al.
Patent Abstracts of Japan, Publication No. 2002-025451, Published Jan. 25, 2002 in the name of Toshihiko et al.
Patent Abstracts of Japan, Publication No. 2002-197981, Published Jul. 12, 2002 in the name of Toshihiro et al.
Patent Abstracts of Japan, Publication No. 2003-016944, Published Jan. 17, 2003 in the name of Kimio.
Patent Abstracts of Japan, Publication No. 2003-031130, Published Jan. 31, 2003in the name of Eishiro et al.
Patent Abstracts of Japan, Publication No. 2003-068212, Published Mar. 7, 2003 in the name of Naoki et al.
Patent Abstracts of Japan, Publication No. 2003-068215, Published Mar. 7, 2003 in the name of Shuichi et al.
Patent Abstracts of Japan, Publication No. 2003-132805. Published May 9, 2003 in the name of Tomohiro et al.
Patent Abstracts of Japan, Publication No. 2004-164885, Published Jun. 10, 2004 in the name of Takashi et al.
Korean Patent Abstracts, Publication No. 1020010016651 A; Publication Date: Mar. 5, 2001; in the name of Park.
Korean Patent Abstracts, Publication No. 1020020055807 A; Publication Date: Jul. 10, 2002; in the name of Kim.
Korean Patent Abstracts, Publication No. 1020030044667 A; Publication Date: Jun. 9, 2003; in the name of Lee.
Patent Abstracts of Japan, Publication No. 05-094772; Publication Date: Apr. 16, 1993; in the name of Noborio.
Patent Abstracts of Japan, Publication No. 10-334811; Publication Date: Dec. 18, 1998; in the name of Aoki et al.
Patent Abstracts of Japan, Publication No. 11-096921; Publication Date: Apr. 9, 1999; in the name of Tomioka et al.
Patent Abstracts of Japan, Publication No. 11-317170; Publication Date: Nov. 16, 1999; in the name of Kado et al.
Patent Abstracts of Japan, Publication No. 2000-042661; Publication Date: Feb. 15, 2000; in the name of Arima et al.
Patent Abstracts of Japan, Publication No. 2000-357459; Publication Date: Dec. 26, 2000; in the name of Jae et al.
Patent Abstracts of Japan, Publication No. 2002-260537; Publication Date: Sep. 13, 2002; in the name of Ito et al.
Patent Abstracts of Japan for Publication No. 10-283934; Date of publication of application: Oct. 23, 1998, in the name of Tsutomu Tokunaga et al.
Patent Abstracts of Japan for Publication No. 11-345570; Date of publication of application: Dec. 14, 1999, in the name of Takaaki Murata et al.
Patent Abstracts of Japan for Publication No. 2000-011899; Date of publication of application: Jan. 14, 2000, in the name of Kimio Amamiya.
Patent Abstracts of Japan for Publication No. 2000-021313; Date of publication of application: Jan. 21, 2000, in the name of Kenji Yoshida et al.
Patent Abstracts of Japan for Publication No. 2000-323045; Date of publication of application: Nov. 24, 2000, in the name of Kazuki Takagi et al.
Patent Abstracts of Japan for Publication No. 2001-283734; Date of publication of application: Oct. 12, 2001, in the name of Sukeyuki Nishimura et al.
Patent Abstracts of Japan for Publication No. 2002-373593; Date of publication of application: Dec. 26, 2002, in the name of Hiroshi Kanda.
Patent Abstracts of Japan, Publication No. 2002-203487, dated Jul. 19, 2002, in the name of Shinichiro Shiromizu.
Patent Abstracts of Japan, Publication No. 2002-203487, dated Jul. 19, 2002, in the name of Shinichiro Shiromizu.
Patent Abstracts of Japan, Publication No. 6-044907, dated Feb. 18, 1994, in the name of Tetsuji Okajima.
Patent Abstracts of Japan, Publication No. 07-065728, dated Mar. 10, 1995, in the name of Tatsutoshi Kanae et al.
Patent Abstracts of Japan, Publication No. 11-031460, dated Feb. 2, 1999, in the name of Takaaki Murata et al.
Patent Abstracts of Japan, Publication No. 2000-082407, dated Mar. 21, 2000, in the name of Toshihiro Komaki et al.
Patent Abstracts of Japan, Publication No. 2000-113828, dated Apr. 21, 2000, in the name of Masaki Kuroki et al.
Patent Abstracts of Japan, Publication No. 2002-093327, dated Mar. 29, 2002, in the name of Masaki Aoki et al.
Patent Abstracts of Japan, Publication No. 2003-157773, dated May 30, 2003, in the name of Tomohiro Kimura et al.
Korean Patents Abstracts for Publication No. 1020030033658; dated May 1, 2003, in the name of Gwang Yeol Choi.
Patent Abstracts of Japan, Publication No. 6-044907, dated Feb. 18, 1994, in the name of Tetsuji Okajima.
Patent Abstracts of Japan, Publication No. 2003-157773, dated May 30, 2003, in the name of Tomohiro Kimura et al.
Korean Patent Abstracts of Publication No. 1020030033658; dated May 1, 2003, in the name of Gwang Yeol Choi.

* cited by examiner

PLASMA DISPLAY PANEL HAVING PROTRUSION ELECTRODE WITH INDENTATION AND APERTURE

CROSS REFERENCE TO RELATED APPLICATIONS

This application claims priority to and the benefit of Korean Patent Application No. 2003-0045199 filed on Jul. 4, 2003, Korean Patent Application No. 2003-0050278 filed on Jul. 22, 2003, Korean Application No. 2003-0052598 filed on Jul. 30, 2003 and Korean Application No. 2003-0053461 filed on Aug. 1, 2003, in the Korean Intellectual Property Office, the entire contents of all of which are incorporated herein by reference.

BACKGROUND OF THE INVENTION (a) Field of the Invention

The present invention relates to a plasma display panel (PDP), and more particularly, to a plasma display panel in which the formation of discharge sustain electrodes is improved to thereby enhance discharge efficiency.

(b) Description of the Related Art

A PDP is a display device that uses vacuum ultraviolet rays generated by gas discharge in discharge cells to excite phosphors, thereby realizing the display of images. With its ability to realize high-resolution images, the PDP is emerging as one of the most popular flat panel display configurations used for wall-mounted televisions and other similar large-screen applications. The different types of PDPs include the AC-PDP, DC-PDP, and the hybrid PDP. The AC PDP utilizing a triode surface discharge structure is becoming the most common configuration.

In the AC PDP with a triode surface discharge structure, address electrodes, barrier ribs, and phosphor layers are formed on a rear substrate corresponding to each discharge cell. Discharge sustain electrodes including scan electrodes and display electrodes are formed on a front substrate. A dielectric layer is formed covering the address electrodes on the rear substrate, and, similarly, a dielectric layer is formed covering the discharge sustain electrodes on the front substrate. Also, discharge gas (typically an Ne—Xe compound gas) is filled in the discharge cells.

Using the above structure, an address voltage Va is applied between an address electrode and a scan electrode to select a discharge cell. Next, a discharge sustain voltage Vs of 150-200V is applied between the display electrode and the scan electrode of the selected discharge cell such that discharge gas effects plasma discharge, and vacuum ultraviolet rays having wavelengths of 147 nm, 150 nm, and 173 nm are emitted from the excited Xe atoms made during plasma discharge. The vacuum ultraviolet rays excite phosphors so that they glow (i.e., emit visible light) and thereby enable color display.

In the PDP operating in this manner, the shape of the discharge sustain electrodes greatly affects sustain discharge characteristics. The first discharge sustain electrodes (i.e., scan electrodes and display electrodes) were transparent electrodes mounted substantially perpendicular to the address electrodes. Further, bus electrodes made of metal were formed on the transparent electrodes to provide a certain degree of conductivity to the transparent electrodes.

However, the discharge sustain electrodes structured as described above are not made with the goal of optimizing discharge characteristics between discharge cells. Also, since the spaces between the transparent electrodes are large, a significant voltage is required. Accordingly, there have been efforts to improve the formation of discharge sustain electrodes to overcome these problems.

U.S. Pat. No. 5,640,068 discloses discharge sustain electrodes in which areas of stripe transparent electrodes opposing barrier ribs are reduced in width. Also, U.S. Pat. No. 5,661,500 discloses discharge sustain electrodes formed using transparent electrodes that protrude into areas of discharge cells from bus electrodes. U.S. Pat. No. 6,288,488 discloses discharge sustain electrodes formed using transparent electrodes that protrude into areas of discharge cells in a "T" configuration from bus electrodes.

However, in all of these patents, pairs of transparent electrodes are provided opposing one another (on the same plane) at a predetermined distance. As a result, when a sustain voltage is applied between the scan electrodes and display electrodes during a sustain interval, plasma discharge starts in the discharge gap between these electrodes, after which the plasma discharge spreads to edges of the discharge cells in roughly an arc configuration.

Such dispersion of plasma discharge causes differences in brightness in even a single discharge cell. That is, following address discharge, during plasma discharge by the collision of electrons (−) accumulated on the display electrodes with ions (+) accumulated on the scan electrodes, the brightest light is generated at the center of the discharge gap between the scan electrodes and display electrodes, then bright light is generated at the scan electrodes, and then at the display electrodes. As a result, non-uniform brightness characteristics result in each of the discharge cells.

Further, in the above patents, although the discharge sustain electrodes include transparent electrodes opposing one another in each of the discharge cells, there are still areas of the transparent electrodes that exist in locations uninvolved with discharging. This increases the amount of power consumed as a result of the relatively large area covered by the transparent electrodes. Also, plasma discharge generated in the discharge cells diffuses to the barrier ribs through the transparent electrodes to thereby reduce discharge efficiency.

SUMMARY OF THE INVENTION

In exemplary embodiments accordance with the present invention, a plasma display panel is provided in which the formation of discharge sustain electrodes is improved such that the diffusion of plasma discharge is varied to improve discharge efficiency.

In an exemplary embodiment of the present invention, a plasma display panel includes a first substrate and a second substrate provided opposing one another with a predetermined gap therebetween; address electrodes formed on the second substrate; barrier ribs mounted between the first substrate and the second substrate, the barrier ribs defining a plurality of discharge cells; phosphor layers formed within the discharge cells; and discharge sustain electrodes formed on the first substrate. The discharge sustain electrodes include bus electrodes that extend such that a pair of the bus electrodes is provided for each of the discharge cells, and protrusion electrodes extending from each of the bus electrodes such that a pair of opposing protrusion electrodes is formed within an area corresponding to each said discharge cell. Also, a distal end of each of the protrusion electrodes opposite a proximal end connected to and extending from the bus electrode includes an indentation at a center area thereof such that a gap is formed between the pair of opposing protrusion electrodes, and an aperture is formed in each of the protrusion electrodes to thereby increase an aperture ratio of the protrusion electrodes.

Each said indentation may be reduced in width along a first direction substantially perpendicular to a second direction in which the address electrodes extend, as the proximal end is approached. The aperture may be formed as region that is not coated with conductive material used to form the protrusion electrodes, and the aperture may decrease in width along a first direction substantially perpendicular to a second direction in which the address electrodes extend, as the proximal end is approached. As an example, the aperture is formed substantially in a shape of a trapezoid.

The address electrodes may be formed in a stripe pattern, and the discharge sustain electrodes may be formed to extend in a first direction substantially perpendicular to a second direction in which the address electrodes extend. In one exemplary embodiment, the barrier ribs are formed in a stripe pattern, each said barrier rib being disposed between a pair of the address electrodes. In another exemplary embodiment, the barrier ribs are formed in a matrix configuration such that discharge cells are defined as independent units.

In yet another exemplary embodiment, the barrier ribs define a plurality of discharge cells and a plurality of non-discharge regions. The non-discharge regions are formed in areas encompassed by discharge cell abscissas that pass through centers of first adjacent discharge cells and discharge cell ordinates that pass through centers of second adjacent discharge cells, the non-discharge cells having a width that is at least as large as a width of distal ends of the barrier ribs. Each of the discharge cells may be formed such that ends of the discharge cells gradually decrease in width along a first direction in which the discharge sustain electrodes extend, as a distance from a center of the discharge cells increases along a second direction in which the address electrodes extend.

The discharge cells may be filled with discharge gas containing approximately 10% or more Xenon, and may be filled with discharge gas containing approximately 10-60% Xenon.

In still another exemplary embodiment, the discharge sustain electrodes include scan electrodes and display electrodes provided such that one said scan electrode and one said display electrode correspond to each row of the discharge cells, the scan electrodes and the display electrodes including protrusion electrodes that extend into areas corresponding to the discharge cells while opposing one another. Also, the address electrodes include line regions that extend along a first direction in which the address electrodes extend, and enlarged regions formed at predetermined locations and expanding along a second direction substantially perpendicular to the first direction to correspond to a shape of protrusion electrodes of the scan electrodes.

The enlarged regions of the address electrodes may have a first width at areas opposing the distal ends of the protrusion electrodes, and have a second width that is smaller than the first width at areas opposing the proximal ends of the protrusion electrodes.

In a further exemplary embodiment, the discharge sustain electrodes include scan electrodes and display electrodes provided such that one said scan electrode and one said display electrode correspond to each row of the discharge cells. In this case, each of the scan electrodes and display electrodes includes one said bus electrode and a plurality of said protrusion electrodes, and one of the bus electrodes of the display electrodes is mounted between adjacent discharge cells of every other row of the discharge cells, and the bus electrodes of the scan electrodes are mounted between adjacent discharge cells and between the bus electrodes of the display electrodes.

The protrusion electrodes of the display electrodes may extend from the bus electrodes of the display electrodes into areas corresponding to discharge cells adjacent to opposite sides of the bus electrodes.

Also, the bus electrodes of the display electrodes may have a width that is greater than a width of the bus electrodes of the scan electrodes.

DETAILED DESCRIPTION

Figure 1:
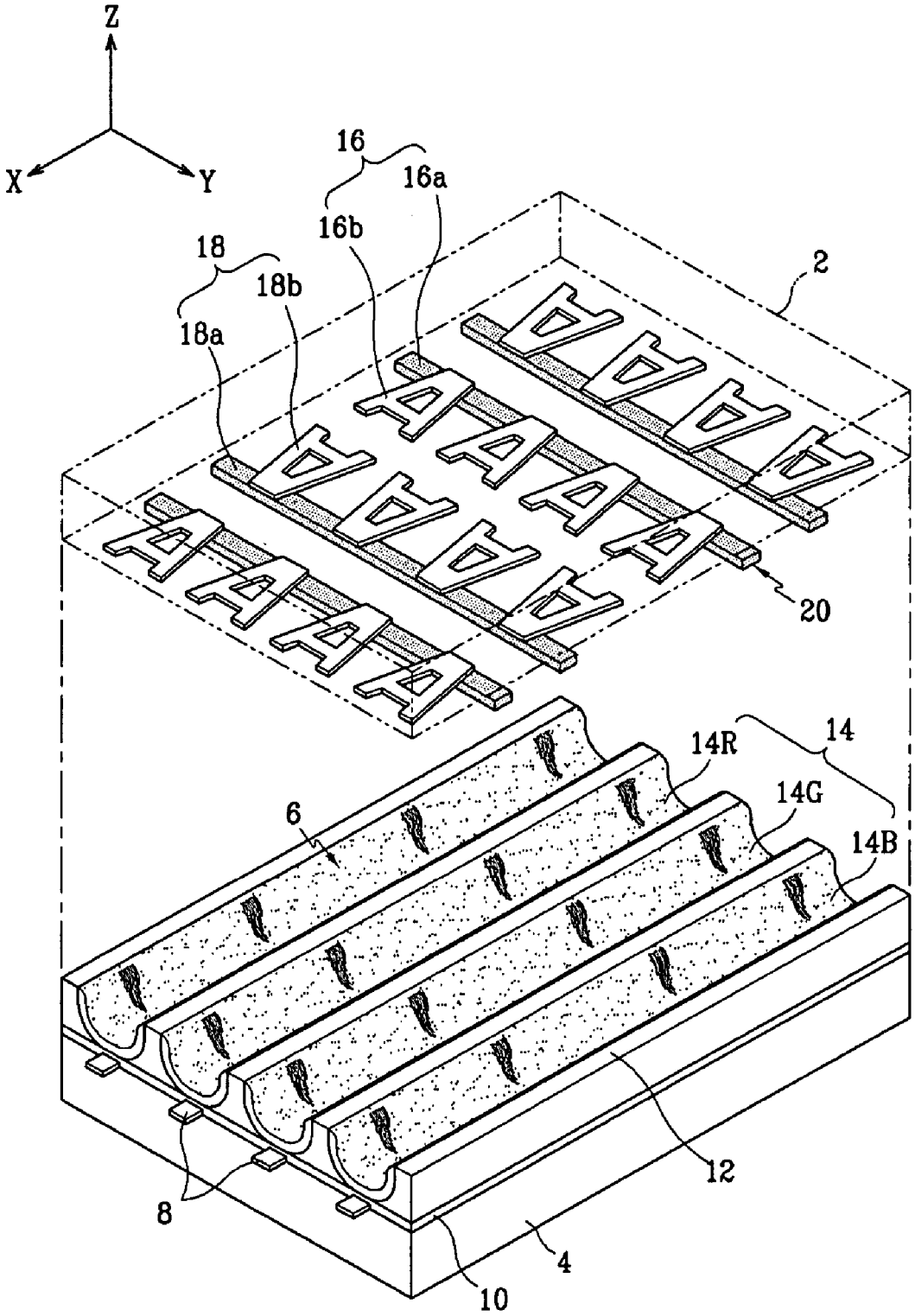
FIG. 1 is a partial exploded perspective view of a plasma display panel according to a first exemplary embodiment of the present invention.
Figure 2:
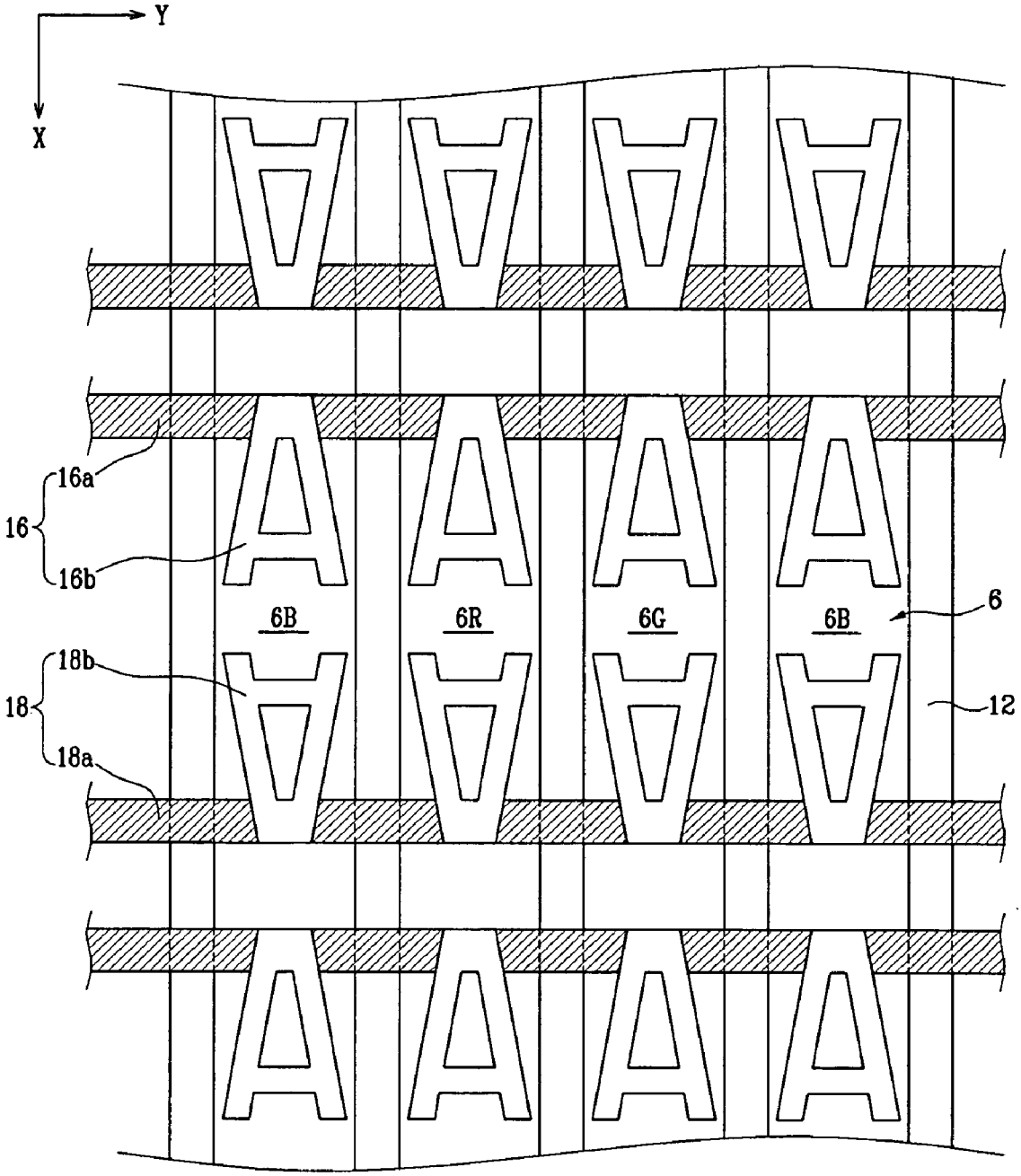
FIG. 2 is a partial plan view of the plasma display panel of FIG. 1.

FIG. 1 is a partial exploded perspective view of a plasma display panel (PDP) according to a first exemplary embodiment of the present invention, and FIG. 2 is a partial plan view of the PDP of FIG. 1.

A PDP according to the first exemplary embodiment includes first substrate 2 and second substrate 4 provided substantially in parallel with a predetermined gap therebetween. Discharge cells 6 are formed between first and second substrates 2 and 4. Independent discharge taking place in each of the discharge cells 6 results in the emission of visible light for the display of color images.

In more detail, address electrodes 8 are formed along one direction (direction X in the drawings) on a surface of second substrate 4 opposing first substrate 2. Dielectric layer 10 is formed over an entire surface of second substrate 4 covering address electrodes 8. Address electrodes 8 are formed in a uniform, stripe pattern with a predetermined interval therebetween.

Barrier ribs 12 are formed on dielectric layer 10. Barrier ribs 12 are formed in a stripe pattern with long axes substantially parallel to the long axes of address electrodes 8. Red, green, and blue phosphor layers 14R, 14G, and 14B are formed along side walls of barrier ribs 12, and on exposed areas of dielectric layer 10 between barrier ribs 12. Barrier ribs 12 are formed to a predetermined height between first and second substrates 2 and 4, and are substantially parallel to address electrodes 8 as described above to thereby form areas of discharge, that is, discharge cells 6.

Discharge sustain electrodes 20 including scan electrodes 16 and display electrodes 18 are formed on a surface of first substrate 2 opposing second substrate 4. Discharge sustain electrodes 20 are formed along a direction substantially perpendicular to the direction along which address electrodes 8 are formed (direction Y). A transparent dielectric layer (not shown) and an MgO protection layer (not shown) are formed over an entire surface of first substrate 2 covering discharge sustain electrodes 20. Discharge cells 6 are formed at areas where address electrodes 8 intersect discharge sustain electrodes 20. Discharge gas (typically an Ne—Xe compound gas) is filled in discharge cells 6.

Discharge sustain electrodes 20 include bus electrodes 16*a* and 18*a* that are formed in a striped pattern and in pairs corresponding to discharge cells 6, and protrusion electrodes 16*b* and 18*b* that are formed extending over discharge cells 6 from bus electrodes 16*a* and 18*a*, respectively. Protrusion electrodes 16*b* and 18*b* are formed using transparent electrodes such as ITO (indium tin oxide) electrodes. In one exemplary embodiment, metal electrodes are used for bus electrodes 16*a* and 18*a*.

Using the above structure, an address voltage Va is applied between address electrodes 8 and scan electrodes 16 to select discharge cells 6 for illumination. Also, a discharge sustain voltage Vs is applied between display electrodes 18 and scan electrodes 16 of the selected discharge cells 6 such that discharge gas effects plasma discharge, and vacuum ultraviolet rays are emitted. The vacuum ultraviolet rays excite phosphor layers 14 (14R, 14G, 14B) of the selected discharge cells 6 so that phosphor layers 14 glow (i.e., emit visible light) and thereby enable color display.

In the PDP of the first exemplary embodiment, an improved structure is applied to discharge sustain electrodes 20. The improved structure includes protrusion electrodes 16*b* and 18*b* of discharge sustain electrodes 20, such that when a sustain voltage is applied between scan electrodes 16 and display electrodes 18, plasma discharge starts substantially simultaneously at a center area and exterior areas of discharge cells 6, and is efficiently diffused.

Figure 3:
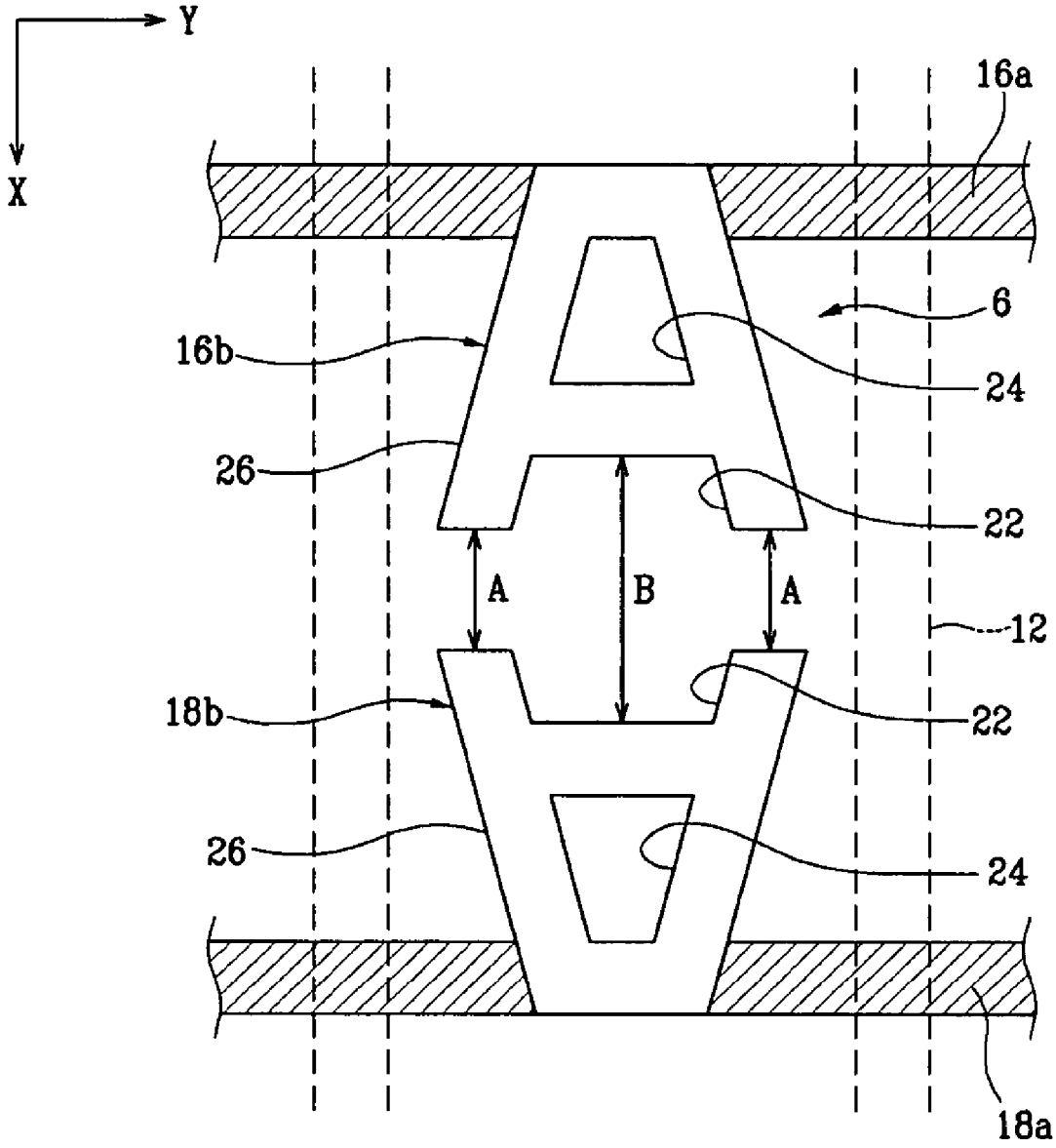
FIGS. 3 and 4 are magnified views of a selected area of FIG. 2.
Figure 4:
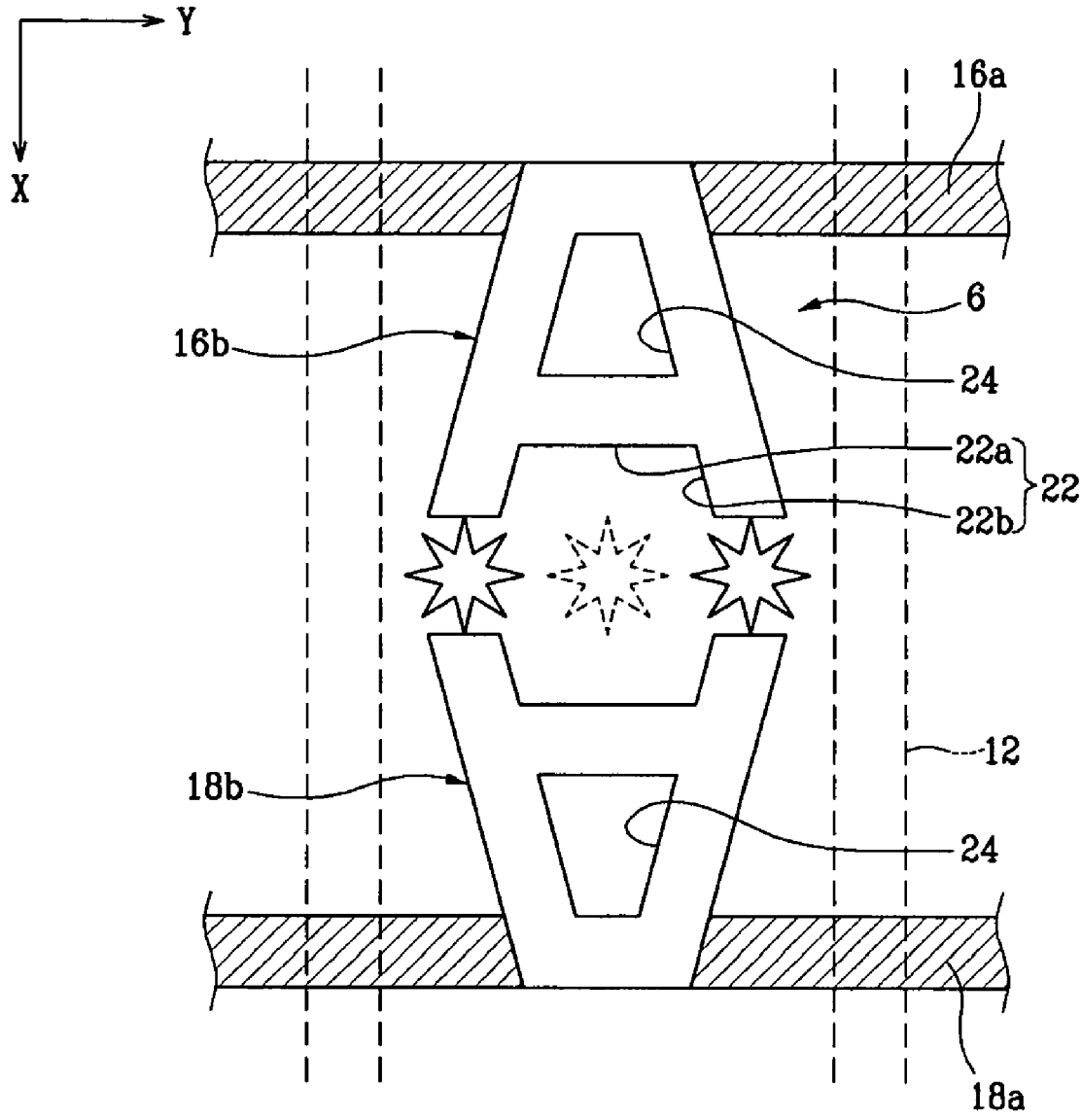

FIGS. 3 and 4 are magnified views of a single discharge cell 6 (i.e., 6R, 6G or 6B) of the discharge cells 6 shown in FIG. 2. Protrusion electrode 16*b* of scan electrode 16 and protrusion electrode 18*b* of display electrode 18 extend from bus electrodes 16*a* and 18*a*, respectively, to oppose each other in discharge cell 6. Distal ends of protrusion electrodes 16*b* and 18*b* are structured such that indentations 22 are formed in center areas along direction Y. Therefore, in discharge cell 6, first discharge gaps A and second discharge gap B of different sizes are formed between opposing protrusion electrodes 16*b* and 18*b*. That is, second discharge gap B is formed where indentations 22 of protrusion electrodes 16*b* and 18*b* oppose one another, and first discharge gaps A are formed where the protruded areas of both sides of indentations 22 of protrusion electrodes 16*b* and 18*b* oppose one another. Also, apertures 24 are formed within each of the protrusion electrodes 16*b* and 18*b* to thereby enhance an aperture ratio of the PDP.

Accordingly, pairs of protrusion electrodes 16*b* and 18*b* are provided with first discharge gaps A having a small size at exterior areas of discharge cells 6, and second discharge gaps B having a larger size at center areas of discharge cells 6. Further, apertures 24 are formed by removing the conductive material of protrusion electrodes 16*b* and 18*b* to better enable the diffusion of plasma discharge in discharge cells 6, and increase an aperture ratio of the PDP to enhance the transmissivity of visible light.

In addition, protrusion electrodes 16*b* and 18*b* are formed decreasing in width along direction Y as a distance from centers of discharge cells 6 is increased in the direction in which address electrodes 8 extend (direction X). To realize such a configuration, angled surfaces 26 (i.e., tapered surfaces) are formed defining both outer sides of each of the protrusion electrodes 16*b* and 18*b*. Angled surfaces 26 are provided at a predetermined angle to long axes of bus electrodes 16*a* and 18*a*, and extend, respectively, from bus electrodes 16*a* and 18*a* at this angle until reaching furthermost distal ends of protrusion electrodes 16*b* and 18*b*. Protrusion electrodes 16*b* and 18*b* including angled surfaces 26 and apertures 24 are reduced in a proximal end area (the general area where protrusion electrodes 16*b* and 18*b* are connected to bus electrodes 16*a* and 18*a*, respectively). Such a configuration poses no problems since these areas are minimally involved in sustain discharge and therefore are sufficiently large for transmitting voltage.

Referring to FIGS. 3 and 4, if a sustain voltage is applied between scan electrode 16 and display electrode 18, plasma discharge begins at centers of first gap A, then spreads outwardly. Plasma discharge also starts at a center of second gap B and spreads outwardly from this area. That is, plasma discharge begins substantially simultaneously at centers of first gaps A and second gap B.

Accordingly, in the PDP of the first exemplary embodiment, since plasma discharge spreads to peripheries of discharge cells 6 starting substantially simultaneously from centers and exterior areas of discharge cells 6, brightness within discharge cells 6 is substantially uniform, and discharge efficiency and instantaneous brightness are enhanced. Further, apertures 24 formed in protrusion electrodes 16*b* and 18*b* further aid with the diffusion of plasma discharge such that a drive voltage of the PDP may be reduced, and also increase a transmissivity of visible light to thereby improve screen brightness.

In one exemplary embodiment, the formation of indentations 22 and apertures 24, and a ratio of areas between apertures 24 and protrusion electrodes 16*b* and 18*b* are applied as described below to improve (e.g., maximize) discharge efficiency.

Indentations 22 are decreased in width along direction Y as bus electrodes 16*a* and 18*a* are approached to thereby result, for example, in the shape of a trapezoid with its base removed. In particular, indentations 22 are defined by horizontal sections 22*a* of protrusion electrodes 16*b* and 18*b* formed along the direction of bus electrodes 16*a* and 18*a*, and center angled sections 22*b* formed extending from both ends of horizontal sections 22*a* at a predetermined angle such that center angled sections 22*b* are substantially parallel to angled surfaces 26.

With the formation of indentations 22 in the shape of a trapezoid (with its base removed), when a sustain voltage is applied between scan electrodes 16 and display electrodes 18, in addition to having plasma discharge begin at the centers of first gaps A then spreading outwardly and begin at the centers of second gaps B then spreading outwardly, plasma discharge also starts in the space between center angled sections 22*b*. Therefore, plasma discharge begins at the center areas and the exterior areas of discharge cells 6 substantially simultaneously.

Further, apertures 24 are also formed with opposing sides decreasing in width along direction Y as bus electrodes 16*a* and 18*a* are approached, to be formed, for example, in the shape of a trapezoid. In addition, the following condition with respect to a ratio of areas between apertures 24 and protrusion electrodes 16*b* and 18*b* is satisfied to ensure that there is no reduction in sustain discharge characteristics and a sufficient aperture ratio to thereby improve screen brightness and realize good plasma discharge.

$$0.1 \leqq D2/D1 \leqq 0.333 \quad \text{[Formula 1]}$$

where D1 is an area of each protrusion electrode 16*b* or 18*b*, and D2 is an area of aperture 24.

Additional exemplary embodiments of the present invention will now be described with reference to FIGS. 5-10. Like reference numerals will be used for elements that are identical to those of the first exemplary embodiment.

Figure 5:
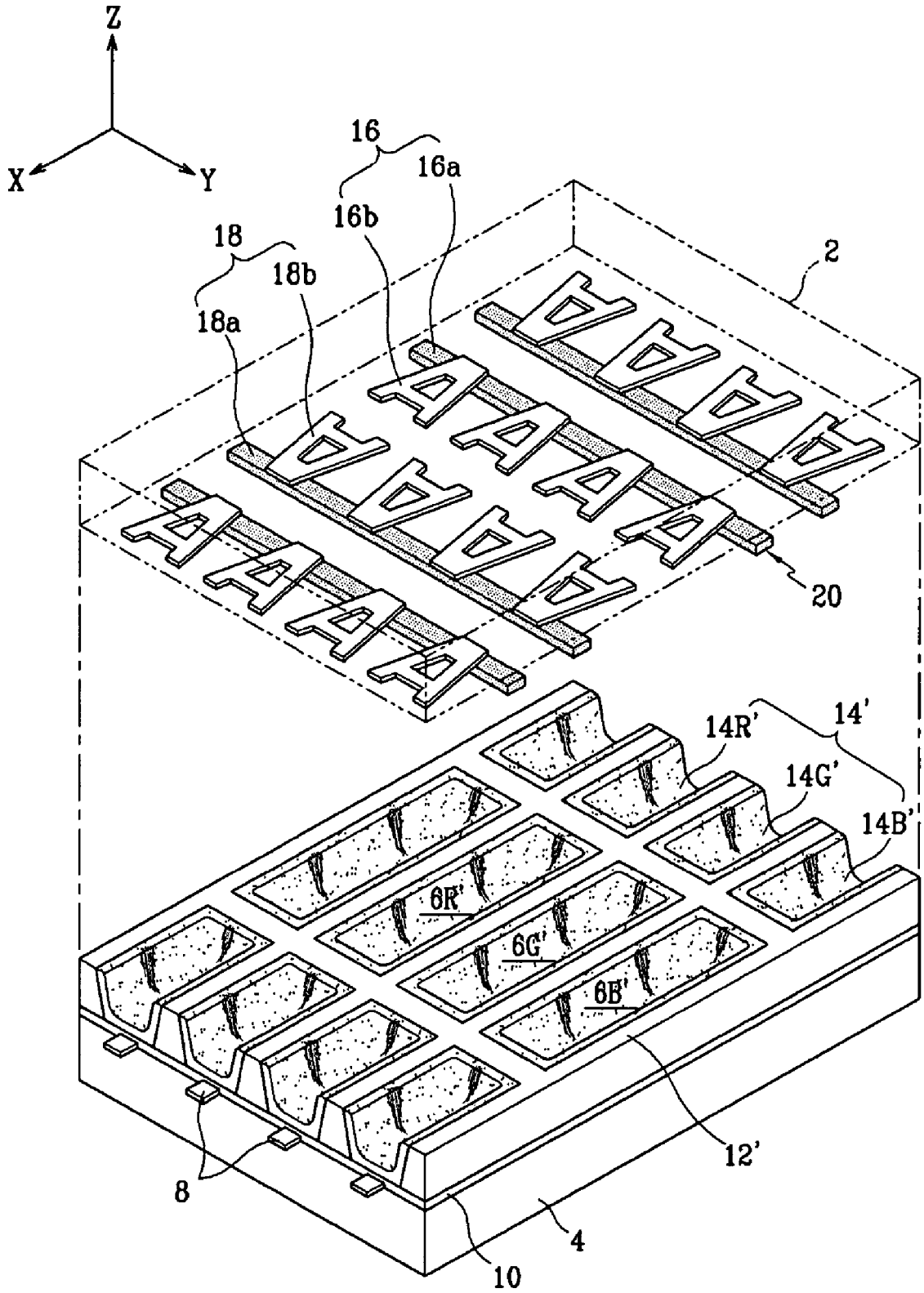
FIG. 5 is a partial exploded perspective view of a plasma display panel according to a second exemplary embodiment of the present invention.

FIG. 5 is a partial exploded perspective view of a plasma display panel according to a second exemplary embodiment of the present invention. Using the basic structure of the first exemplary embodiment, barrier ribs 12' are formed on dielectric layer 10 of second substrate 4 in a matrix configuration. Barrier ribs 12' in a matrix configuration define discharge cells 6R', 6G', and 6B' as individual units to thereby prevent crosstalk between adjacent discharge cells 6R', 6G', and 6B'. Further, phosphor layers 14' (14R', 14G' 14B') are formed along all inner walls of barrier ribs 12' defining discharge cells 6R', 6G', and 6B', as well as on exposed areas of dielectric layer 10 within discharge cells 6R', 6G', and 6B'.

Figure 6:
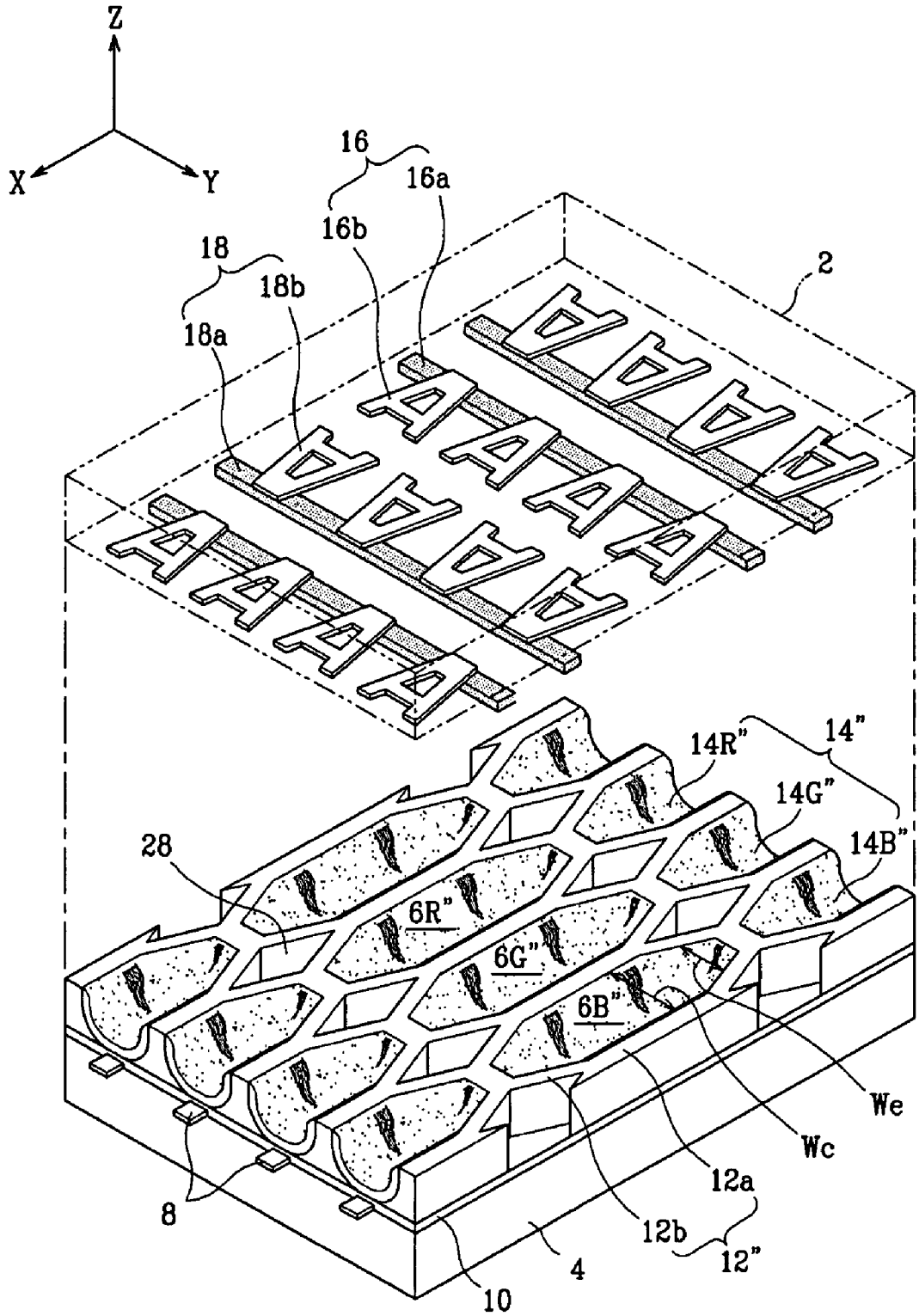
FIG. 6 is a partial exploded perspective view of a plasma display panel according to a third exemplary embodiment of the present invention.
Figure 7:
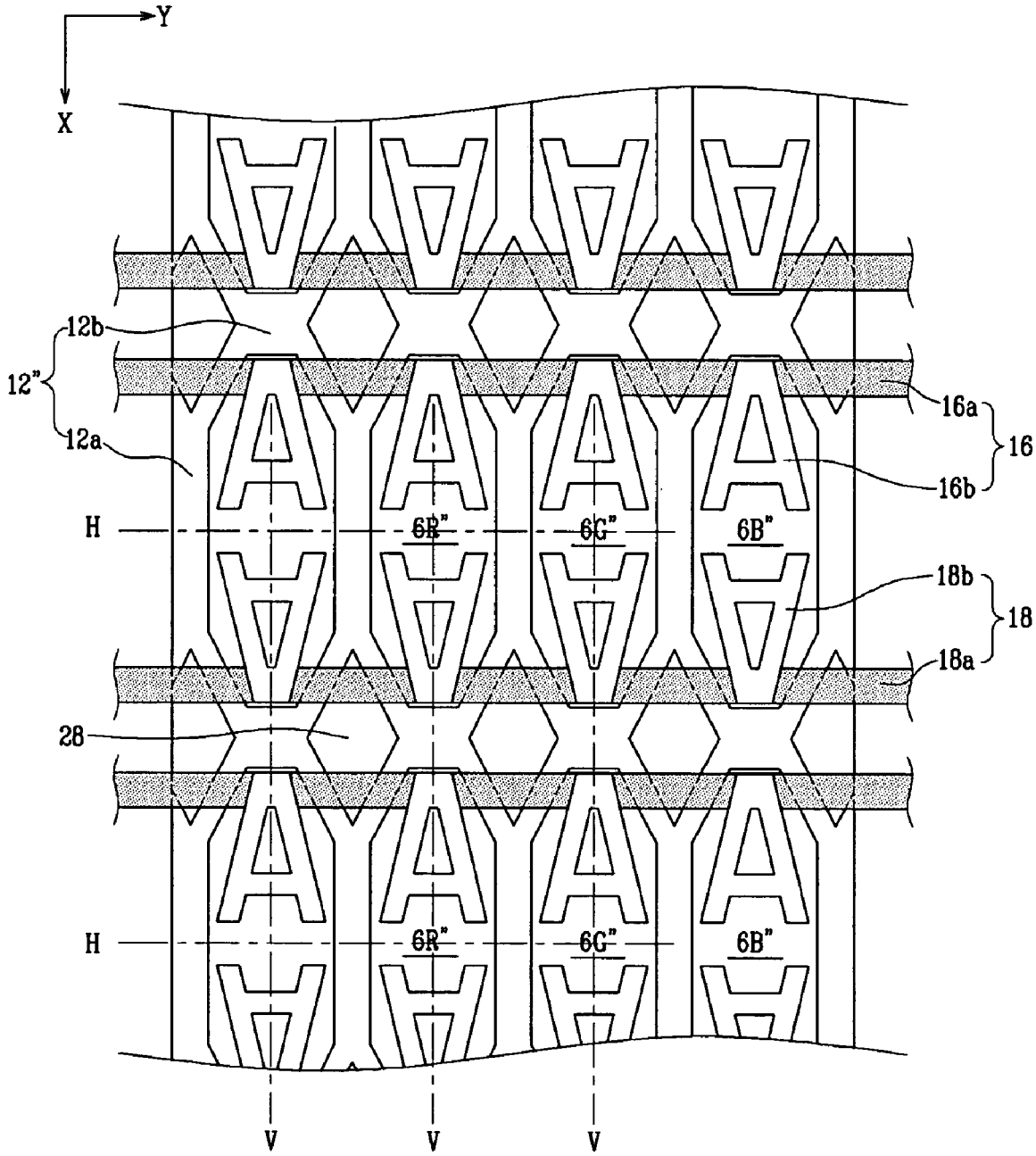
FIG. 7 is a partial plan view of the plasma display panel of FIG. 6.

FIG. 6 is a partial exploded perspective view of a plasma display panel according to a third exemplary embodiment of the present invention, and FIG. 7 is a partial plan view of the plasma display panel of FIG. 6. Using a structure similar to that of the second exemplary embodiment, barrier ribs 12" define discharge cells 6R", 6G", and 6B", and also non-discharge regions 28 in the gap between first substrate 2 and second substrate 4 and on dielectric layer 10. Discharge cells 6R", 6G", and 6B" designate areas in which discharge gas is provided and where gas discharge is expected to take place, and non-discharge regions 28 are areas where a voltage is not applied such that gas discharge (i.e., illumination) is not expected to take place therein.

Non-discharge regions 28 defined by barrier ribs 12" are formed in areas encompassed by discharge cell abscissas H and ordinates V that pass through centers of each of the discharge cells 6R", 6G", and 6B", and that are respectively aligned with direction Y and direction X. In one exemplary embodiment, non-discharge regions 28 are centered between adjacent abscissas H and adjacent ordinates V. Stated differently, in one exemplary embodiment each pair of discharge cells 6R", 6G", and 6B" adjacent to one another along direction X has a common non-discharge region 28 with another such pair of discharge cells 6R", 6G", and 6B" adjacent along direction Y. With this configuration realized using barrier ribs 12", each of the non-discharge regions 28 has an independent cell structure.

Each of the discharge cells 6R", 6G", and 6B" is formed with ends that reduce in width in the direction in which discharge sustain electrodes 20 extend (direction Y), as a distance from a center of each of the discharge cells 6R", 6G", and 6B" is increased in the direction in which address electrodes 8 extend (direction X).

That is, as shown in FIG. 6, a width Wc of a mid-portion of discharge cells 6R", 6G", and 6B" is greater than a width We of the ends of discharge cells 6R", 6G", and 6B", with width We of the ends decreasing up to a certain point as the distance from the center of the discharge cells 6R", 6G", and 6B" is increased. Therefore, the ends of discharge cells 6R", 6G", and 6B" are formed in the shape of a trapezoid (with its ends removed) until reaching a predetermined location where barrier ribs 12" close off discharge cells 6R", 6G", and 6B". This results in each of the discharge cells 6R", 6G", and 6B" having an overall planar shape of an octagon. Phosphor layers 14R", 14G", and 14B" cover all inner surfaces of discharge cells 6R", 6G", and 6B", respectively, that is, inner walls of barrier ribs 12" defining discharge cells 6R", 6G", and 6B", as well as exposed surfaces of dielectric layer 10 within discharge cells 6R", 6G", and 6B".

Barrier ribs 12" defining non-discharge regions 28 and discharge cells 6R", 6G", and 6B" in the manner described above include first barrier rib members 12*a* that are parallel to address electrodes 8, and second barrier rib members 12*b* that define the ends of discharge cells 6R", 6G", and 6B" as described above and so are not parallel to address electrodes 8. In the third exemplary embodiment, second barrier rib members 12*b* are formed extending up to a point at a predetermined angle to first barrier rib members 12*a*, then extending in the direction in which discharge sustain electrodes 20 are formed to cross over address electrodes 8. Therefore, second barrier rib members 12*b* are formed in generally an X shape between discharge cells 6R", 6G", and 6B" adjacent along the direction of address electrodes 8. Second barrier rib members 12*b* can further separate diagonally adjacent discharge cells with a non-discharge region therebetween.

With discharge cells 6R", 6G", and 6B" provided in an improved (e.g., optimum) configuration with respect to the manner in which plasma discharge is diffused (i.e., starting in spaces between two opposing protruding electrodes and spreading in all directions from this area), phosphor layers 14" produce vacuum ultraviolet rays of a greater intensity over a greater area during generation of vacuum ultraviolet rays by plasma discharge.

Accordingly, the efficiency of phosphors in converting effective ultraviolet rays into visible light is improved in the third exemplary embodiment, thereby resulting in enhanced discharge efficiency and screen brightness. Further, non-discharge regions 28 absorb heat emitted from discharge cells 6R", 6G", and 6B", and expel this heat to outside the PDP such that heat-emitting characteristics of the PDP are improved.

In addition, protrusion electrodes 16*b* and 18*b* are formed with first and second gaps A and B interposed therebetween to thereby reduce a discharge firing voltage Vf. Accordingly, in the third exemplary embodiment, the amount of Xe contained in the discharge gas may be increased without having to increase the discharge firing voltage Vf. Therefore, the discharge gas filled in discharge cells 6 contains 10% or more Xe. In one exemplary embodiment, by way of example, the discharge gas contains 10~60% Xe. With the increased Xe content, vacuum ultraviolet rays may be emitted with a greater intensity to thereby enhance screen brightness.

Figure 8:
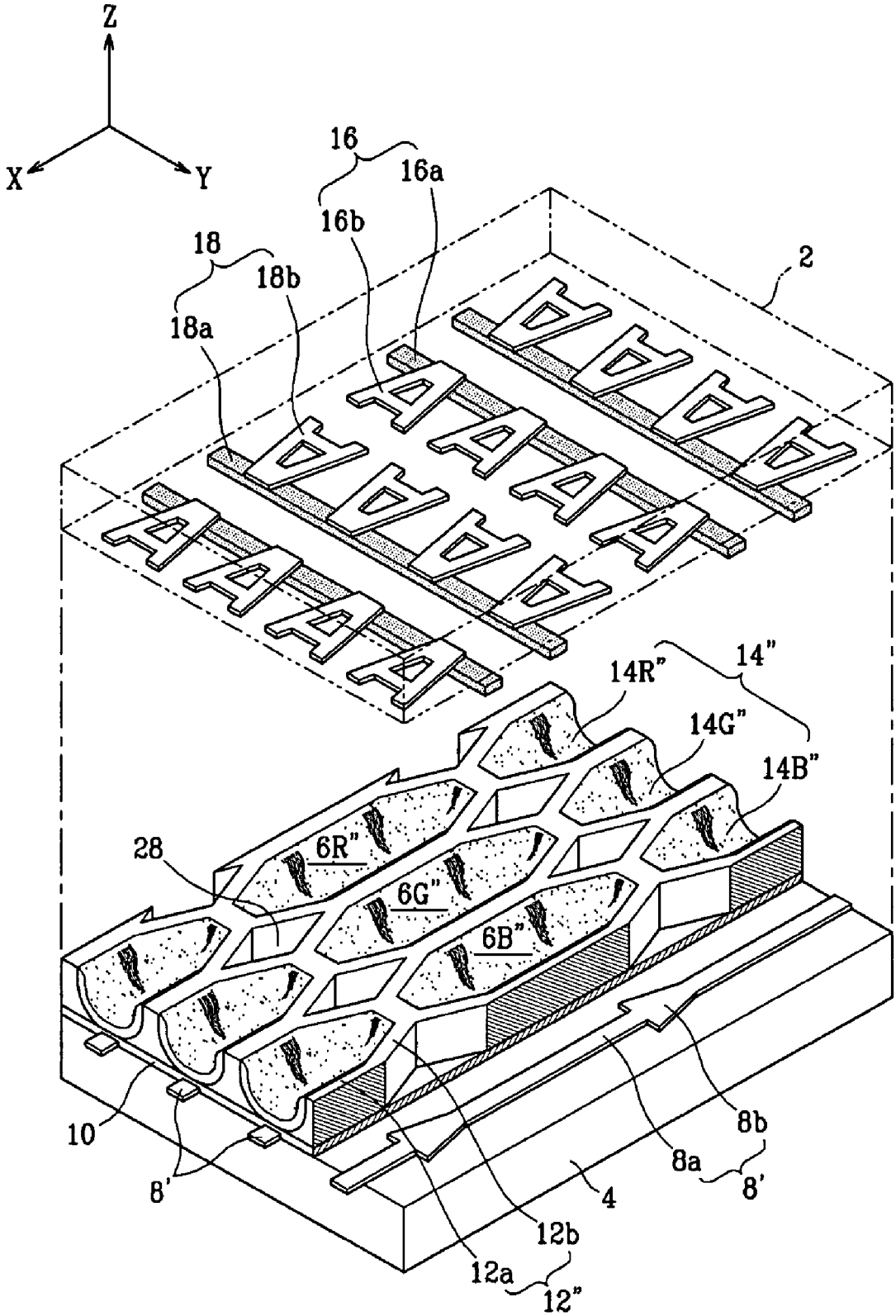
FIG. 8 is a partial exploded perspective view of a plasma display panel according to a fourth exemplary embodiment of the present invention.
Figure 9:
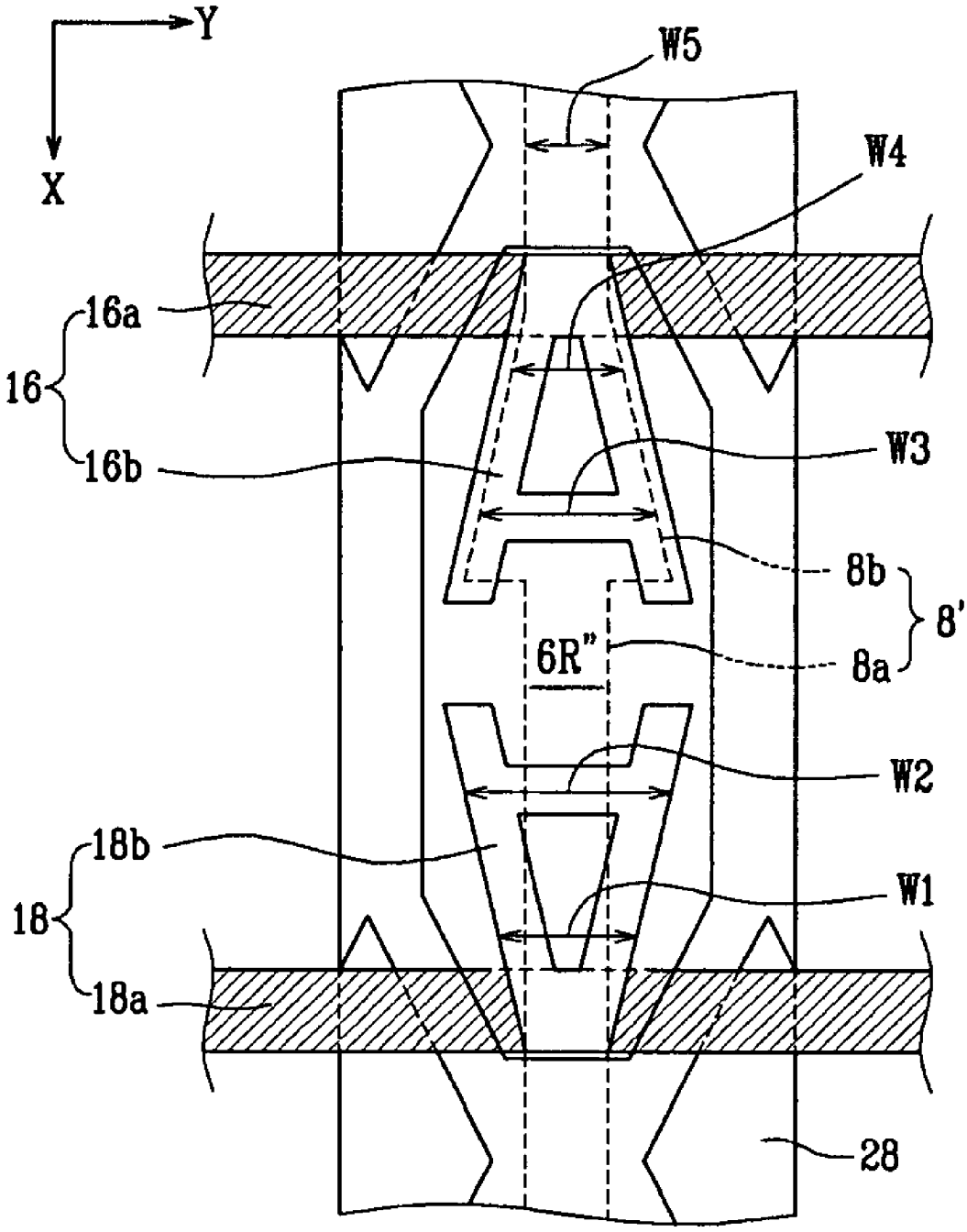
FIG. 9 is a magnified plan view of a selected area of FIG. 8.

FIG. 8 is a partial exploded perspective view of a plasma display panel according to a fourth exemplary embodiment of the present invention, and FIG. 9 is a magnified plan view of a selected area of FIG. 8.

In the PDP according to the fourth exemplary embodiment, barrier ribs 12" define non-discharge regions 28 and discharge cells 6R", 6G", and 6B" as in the third exemplary embodiment. Further, discharge sustain electrodes 16 and 18 are formed to extend in a direction (direction Y) substantially perpendicular to the direction in which address electrodes 8 extend. Discharge sustain electrodes 16 and 18 include bus electrodes 16*a* and 18*a* that extend in direction Y, and protrusion electrodes 16*b* and 18*b* that extend, respectively, from bus electrodes 16*a* and 18*a* in direction X.

For each row of discharge cells 6R", 6G", and 6B" along direction Y, bus electrode 16*a* extends along one end of discharge cells 6R", 6G", and 6B", and bus electrode 18*a* extends along an opposite end of discharge cells 6R", 6G", and 6B". Therefore, each of the discharge cells 6R", 6G", and 6B" has one of the bus electrodes 16*a* positioned over one end, and one of the bus electrodes 18*a* positioned over its other end. Protrusion electrodes 16*b* overlap and protrude from corresponding bus electrode 16*a* into the areas of the discharge cells 6R", 6G", and 6B". Also, protrusion electrodes 18*b* overlap and protrude from the corresponding bus electrode 18*a* into the areas of discharge cells 6R", 6G", and 6B". Therefore, one protrusion electrode 16*b* and one protrusion electrode 18*b* are formed opposing one another in each area corresponding to each of the discharge cells 6R", 6G", and 6B".

Proximal ends of protrusion electrodes 16*b* and 18*b* (i.e., where protrusion electrodes 16*b* and 18*b* are attached to and extend from bus electrodes 16*a* and 18*a*, respectively) are formed corresponding to the shape of the ends of discharge cells 6R", 6G", and 6B". That is, the proximal ends of protrusion electrodes 16*b* and 18*b* reduce in width along direction Y as the distance from the center of discharge cells 6R", 6G", and 6B" along direction X is increased to thereby correspond to the shape of the ends of discharge cells 6R", 6G", and 6B".

Discharge sustain electrodes 16 are scan electrodes, and discharge sustain electrodes 18 are display electrodes.

In the fourth exemplary embodiment, address electrodes 8' include enlarged regions 8*b* formed substantially corresponding to the shape and location of protrusion electrodes 16*b* of scan electrodes 16. Enlarged regions 8*b* increase an area of scan electrodes 16 that oppose address electrodes 8'. In more detail, address electrodes 8' include line regions 8*a* formed along direction X, and enlarged regions 8*b* formed at predetermined locations and expanding along direction Y corresponding to the outer shape of protrusion electrodes 16*b*.

As shown in FIG. 9, when viewed from a front of the PDP, areas of enlarged regions 8*b* of address electrodes 8' opposing distal ends of protrusion electrodes 16*b* of scan electrodes 16 are generally rectangular having width W3, and areas of enlarged regions 8*b* of address electrodes 8' opposing proximal ends of protrusion electrodes 16*b* of scan electrodes 16 are substantially wedge-shaped having width W4 that is less than width W3 and that decreases gradually as bus electrodes 16*a* are approached. With width W5 corresponding to the width of line regions 8*a* of address electrodes 8', the following inequalities are maintained: W3>W5 and W4>W5.

With the formation of enlarged regions 8*b* at areas opposing scan electrodes 16 of address electrodes 8' as described above, address discharge is activated when an address voltage is applied between address electrodes 8' and scan electrodes 16, and the influence of display electrodes 18 is not received. Accordingly, in the PDP of the fourth exemplary embodiment, address discharge is stabilized such that mis-discharge is prevented during address discharge and sustain discharge, and an address voltage margin is increased.

Address electrodes 8' of the fourth exemplary embodiment may also be applied to the PDPs of the first and second exemplary embodiments.

Figure 10:
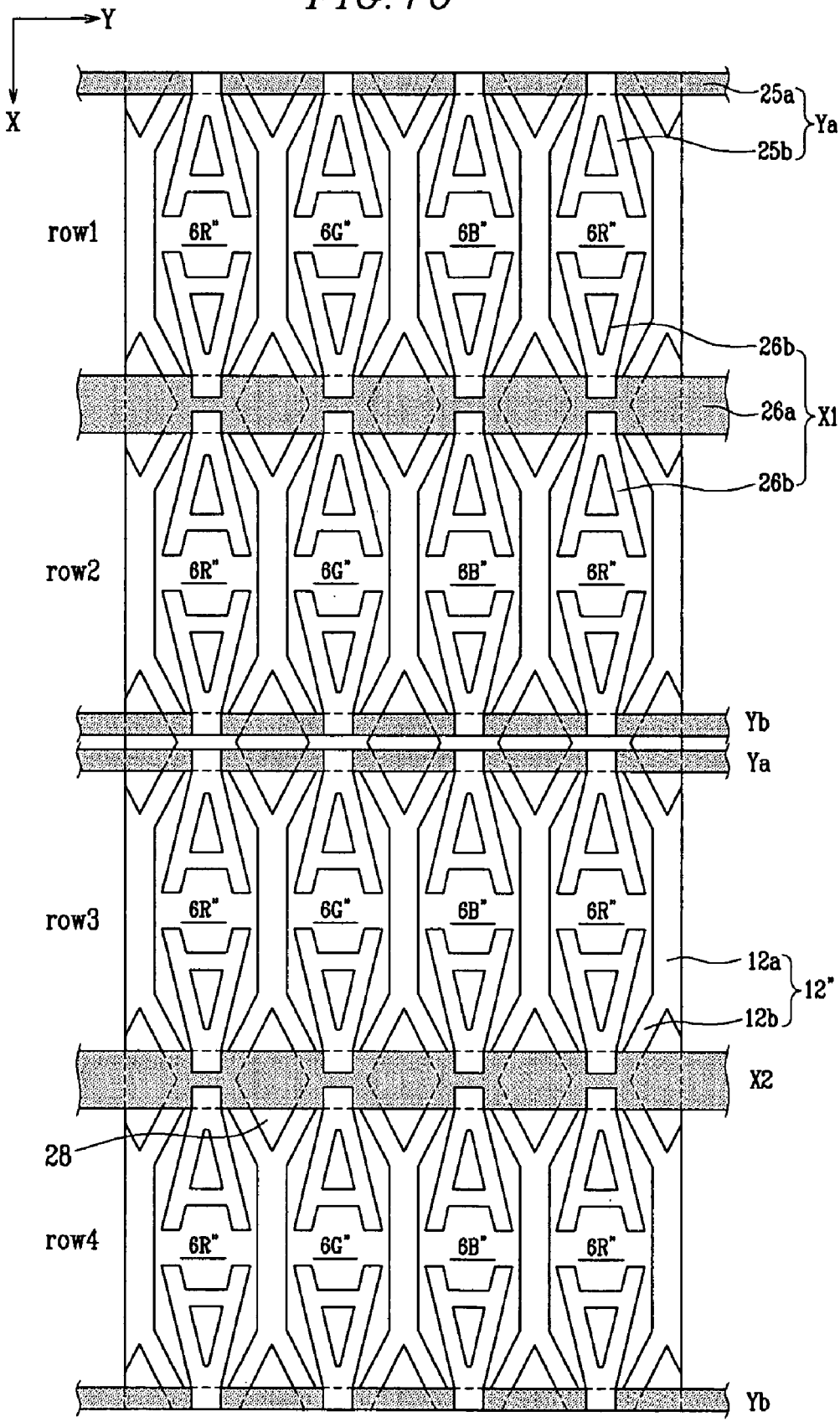
FIG. 10 is a partial plan view of a plasma display panel according to a fifth exemplary embodiment of the present invention.

FIG. 10 is a partial plan view of a plasma display panel according to a fifth exemplary embodiment of the present invention. In the PDP according to the fifth exemplary embodiment, barrier ribs 12" define non-discharge regions 28 and discharge cells 6R", 6G", and 6B" as in the third exemplary embodiment. Further, discharge sustain electrodes are formed to extend in a direction (direction Y) substantially perpendicular to the direction in which address electrodes 8 are formed to extend. The discharge sustain electrodes include scan electrodes (Ya, Yb) and display electrodes Xn (where n=1, 2, 3, . . . ).

Scan electrodes (Ya, Yb) and display electrodes Xn include bus electrodes 25*a* and 26*a*, respectively, that extend along the direction along which address electrodes 8 are formed (direction Y), and protrusion electrodes 25*b* and 26*b* that extend, respectively, from bus electrodes 25*a* and 26*a* such that a pair of protrusion electrodes 25*b* and 26*b* oppose one another in each discharge cell 6R", 6G", and 6B". Bus electrodes 25*a* and 26*a* are formed to the outside of discharge cells 6R", 6G", and 6B" crossing into non-discharge regions 28. Scan electrodes (Ya, Yb) act together with address electrodes 8 to select discharge cells 6R", 6G", and 6B", and display electrodes Xn initialize discharge and generate sustain discharge between scan electrodes (Ya, Yb).

Using the term "rows" to describe lines of discharge cells 6R", 6G", and 6B" adjacent along direction Y, bus electrodes 26*a* of display electrodes Xn are provided such that one of the bus electrodes 26*a* is formed between ends of adjacent discharge cells 6R", 6G", and 6B" in every other pair of rows adjacent along direction X. Further, bus electrodes 25*a* of scan electrodes (Ya, Yb) are provided such that one bus electrode 25*a* of scan electrodes Ya and one bus electrode 25*a* of scan electrodes Yb are formed between ends of adjacent discharge cells 6R", 6G", and 6B" in every other pair of rows adjacent along direction X. Along this direction X, scan electrodes (Ya, Yb) and display electrodes Xn are provided in an overall pattern of Ya-X1-Yb-Ya-X2-Yb-Ya-X3-Yb- . . . -Ya-Xn-Yb. With this configuration, display electrodes Xn are able to participate in the discharge operation of all discharge cells 6R", 6G", and 6B".

Bus electrodes 26*a* of display electrodes Xn are formed covering a greater area along direction X than pairs of bus electrodes 25*a* of scan electrodes (Ya, Yb). This is because bus electrodes 26*a* of display electrodes Xn absorb outside light to thereby improve contrast.

In the PDP of the present invention described above, plasma discharges almost simultaneously at the center areas and outer areas of the discharge cells before spreading to peripheries of the discharge cells. As a result, there is substantially uniform brightness in the discharge cells, and discharge efficiency and screen brightness are improved. Further, the apertures formed in the protrusion electrodes further aid in the diffusion of plasma discharge to thereby reduce the drive voltage needed for the PDP, and increase the transmissivity of visible light to thereby additionally enhance screen brightness.

Although certain exemplary embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims and equivalents thereof.

What is claimed is:

1. A plasma display panel, comprising:

a first substrate and a second substrate provided opposing one another with a predetermined gap therebetween;

address electrodes formed on the second substrate;

barrier ribs mounted between the first substrate and the second substrate, the barrier ribs defining a plurality of discharge cells;

phosphor layers formed within the discharge cells; and discharge sustain electrodes formed on the first substrate, wherein the discharge sustain electrodes include bus electrodes that extend such that a pair of the bus electrodes is provided for each of the discharge cells, and protrusion electrodes extending from and forming an angle different from right angle with each of the bus electrodes such that a pair of opposing protrusion electrodes, one member of the pair being a mirror image of the other, is formed within an area corresponding to each said discharge cell and wherein a distal end of each of the protrusion electrodes opposite a proximal end connected to and extending from the bus electrode includes an indentation at a center area thereof such that a gap is formed between the pair of opposing protrusion electrodes, and an aperture is formed in each of the protrusion electrodes to thereby increase an aperture ratio of the protrusion electrodes.

2. The plasma display panel of claim 1, wherein each said indentation is reduced in width along a first direction substantially perpendicular to a second direction in which the address electrodes extend, as the proximal end is approached.

3. The plasma display panel of claim 2, wherein the indentations have substantially a shape of a trapezoid with its base removed.

4. The plasma display panel of claim 1, wherein the aperture is formed as a region that is not coated with conductive material used to form the protrusion electrodes.

5. The plasma display panel of claim 1, wherein the aperture decreases in width along a first direction substantially perpendicular to a second direction in which the address electrodes extend, as the proximal end is approached.

6. The plasma display panel of claim 5, wherein the aperture has substantially a shape of a trapezoid.

7. The plasma display panel of claim 1, wherein each said protrusion electrode decreases in width along a first direction substantially perpendicular to a second direction in which the address electrodes extend, as the proximal end is approached.

8. The plasma display panel of claim 7, wherein each said protrusion electrode has substantially a shape of a trapezoid.

9. The plasma display panel of claim 1, wherein the protrusion electrodes satisfy the following condition, $$0.1 \leqq D2/D1 \leqq 0.333$$

where Dl is an area of each said protrusion electrode, and D2 is an area of the aperture.

10. The plasma display panel of claim 1, wherein the bus electrodes are metal electrodes.

11. The plasma display panel of claim 1, wherein the protrusion electrodes are transparent electrodes.

12. The plasma display panel of claim 1, wherein the address electrodes are formed in a stripe pattern, and the discharge sustain electrodes are formed to extend in a first direction substantially perpendicular a second direction in which the address electrodes extend.

13. The plasma display panel of claim 12, wherein the barrier ribs are formed in a stripe pattern, each said barrier rib being disposed between a pair of the address electrodes.

14. The plasma display panel of claim 1, wherein the barrier ribs are formed in a matrix configuration such that discharge cells are defined as independent units.

15. A plasma display panel, comprising:

a first substrate and a second substrate provided opposing one another with a predetermined gap therebetween;

address electrodes formed on the second substrate;

barrier ribs mounted between the first substrate and the second substrate, the barrier ribs defining a plurality of discharge cells and a plurality of non-discharge regions;

phosphor layers formed within the discharge cells; and discharge sustain electrodes formed on the first substrate, wherein the non-discharge regions are formed in areas encompassed by discharge cell abscissas that pass through centers of first adjacent discharge cells and discharge cell ordinates that pass through centers of second adjacent discharge cells, each of the non-discharge regions being defined by at least two of the barrier ribs adjacent to the non-discharge region, wherein the discharge sustain electrodes include bus electrodes that extend such that a pair of the bus electrodes is provided for each of the discharge cells, and transparent protrusion electrodes extending from and forming an angle different from right angle with each of the bus electrodes such that a pair of opposing protrusion electrodes, one member of the pair being a mirror image of the other, is formed within an area corresponding to each discharge cell, and wherein a distal end of each of the protrusion electrodes opposite a proximal end connected to and extending from the bus electrode includes an indentation at a center area thereof to thereby form a first discharge gap and a second discharge gap of different sizes, and an aperture is formed in each of the protrusion electrodes to thereby increase an aperture ratio of the protrusion electrodes.

16. The plasma display panel of claim 15, wherein each of the discharge cells is formed such that ends of the discharge cells gradually decrease in width along a first direction in which the discharge sustain electrodes extend, as a distance from a center of the discharge cells increases along a second direction in which the address electrodes extend.

17. The plasma display panel of claim 16, wherein ends of each of the discharge cells have a planar configuration substantially in a shape of a trapezoid with its base removed.

18. The plasma display panel of claim 15, wherein the non-discharge regions are formed into independent cell structures by the barrier ribs.

19. The plasma display panel of claim 15, wherein the discharge cells are filled with discharge gas containing approximately 10% or more Xenon.

20. The plasma display panel of claim 15, wherein the discharge cells are filled with discharge gas containing approximately 10-60% Xenon.

21. The plasma display panel of claim 15, wherein the discharge sustain electrodes include scan electrodes and display electrodes provided such that one said scan electrode and one said display electrode correspond to each row of the discharge cells, the scan electrodes and the display electrodes including protrusion electrodes that extend into areas corresponding to the discharge cells while opposing one another, wherein the address electrodes include line regions that extend along a first direction in which the address electrodes extend, and enlarged regions formed at predetermined locations and expanding along a second direction substantially perpendicular to the first direction to correspond to a shape of protrusion electrodes of the scan electrodes.

22. The plasma display panel of claim 21, wherein the enlarged regions of the address electrodes have a first width at areas opposing the distal ends of the protrusion electrodes, and have a second width that is smaller than the first width at areas opposing the proximal ends of the protrusion electrodes.

23. The plasma display panel of claim 15, wherein the discharge sustain electrodes include scan electrodes and display electrodes provided such that one said scan electrode and one said display electrode correspond to each row of the discharge cells, wherein each of the scan electrodes and display electrodes includes one said bus electrode and a plurality of said protrusion electrodes, wherein one of the bus electrodes of the display electrodes is mounted between adjacent discharge cells of every other row of the discharge cells, and the bus electrodes of the scan electrodes are mounted between adjacent discharge cells and between the bus electrodes of the display electrodes.

24. The plasma display panel of claim 23, wherein the protrusion electrodes of the display electrodes extend from the bus electrodes of the display electrodes into areas corresponding to discharge cells adjacent to opposite sides of the bus electrodes.

25. The plasma display panel of claim 23, wherein the bus electrodes of the display electrodes have a width that is greater than a width of the bus electrodes of the scan electrodes.

* * * * *